United States Patent [19]

Schelhas

[11] 4,288,037

[45] Sep. 8, 1981

[54] FUEL INJECTION VALVE

[75] Inventor: Peter Schelhas, Stuttgart, Fed. Rep. of Germany

[73] Assignee: Robert Bosch GmbH, Stuttgart, Fed. Rep. of Germany

[21] Appl. No.: 99,281

[22] Filed: Dec. 3, 1979

[30] Foreign Application Priority Data

Jan. 11, 1979 [DE] Fed. Rep. of Germany ..... 2900847

[51] Int. Cl.[3] ..... B05B 1/34

[52] U.S. Cl. ..... 239/434.5; 239/533.2

[58] Field of Search ..... 239/533.2, 533.3, 533.7, 239/533.9, 584, 408, 409, 410, 95, 411, 585, 533.12, 459, 456, 434.5

[56] References Cited

U.S. PATENT DOCUMENTS 2,860,780 11/1958 Ziesche et al. ..... 239/533.12 X 2,913,187 11/1959 Anderson ..... 239/410 X 3,782,639 1/1974 Boltz et al. ..... 239/585 X

*Primary Examiner*—Andres Kashnikow

*Assistant Examiner*—Gene A. Church

*Attorney, Agent, or Firm*—Edwin E. Greigg

[57] ABSTRACT

A fuel injection valve is proposed that serves for low-pressure fuel injection into the intake manifold of a mixture-compressing, externally ignited internal combustion engine. The fuel injection valve (1) includes a valve needle (12,12'') which opens against the force of a closing spring (22), and this valve needle has downstream of the valve seat (16, 16'') a fuel guidance cone (17, 17', 17'') which tapers in the direction of fuel flow. The fuel guidance cone (17,17', 17'') is so disposed that it projects into an air chamber (26) of the fuel injection valve (1) connected to an air line (9). The fuel guidance cone (17, 17', 17'') may be embodied either conically or with a surface which extends in a concave manner and tapers tangentially toward the conical tip (29, 29'). An embodiment of a fuel injection valve (1) of this kind with a fuel guidance cone (17, 17', 17''), even lacking an air envelope during full-load or during the transition from idle to full-load assures the formation of a focused fuel jet without dampening the wall of an ejection nozzle (28) provided in alignment with the valve needle (12,12'') on the fuel injection valve.

6 Claims, 4 Drawing Figures

FUEL INJECTION VALVE

BACKGROUND OF THE INVENTION

This invention relates to a fuel injection valve for low pressure injection into the intake manifold of a mixture comprising, externally ignited internal combustion engine. In particular this invention relates to a fuel injection valve in which an envelope of air derived from the intake manifold is formed around the injector to prevent the fuel from wetting the walls of the nozzle. The disadvantage of the present nozzles of this type is that during the transition form idle to full load and during full load operation the pressure drop between the intake manifold upstream from the throttle and the nozzle is not sufficient to form the air envelope. Thus, some of the fuel from the injector valve attaches to the nozzle wall and is not available for combustion in the cylinder.

The present invention overcomes this disadvantage by providing the injector valve with a geometry that will insure adherence of fuel to the injector with no air envelope.

OBJECTS OF THE INVENTION

It is an object of this invention to provide a fuel injection valve that will insure proper fuel flow under all engine operating conditions.

It is a further object of this invention to provide a fuel injection valve that insures adherence of fuel to the fuel guidance cone surface under all operating conditions.

It is a further object of this invention to provide a fuel injection valve where the valve opens in the direction of fuel flow.

It is yet another object of this invention to provide a fuel injection valve where the valve opens opposite to the direction of fuel flow.

It is a final object of this invention to provide a fuel injection valve which minimizes cross flow of the injected fuel.

SUMMARY OF THE INVENTION

The present invention provides a fuel injection valve having tapered surfaces on each end of a fuel guidance cone of the valve needle and a cylindrical portion between the tapered surfaces. The tapered surface adjacent the nozzle may be a plain tapered surface or, as in one illustrated embodiment of concave tapered surface. Depending upon the geometry of the valve it may be positioned to open either in the direction of fuel flow or in a direction opposite to that of the fuel flow. The geometry of the valve and its position in the system insures proper fuel flow during all engine operating conditions.

DESCRIPTION OF THE PREFERRED EMBODIMENTS

Figure 1:
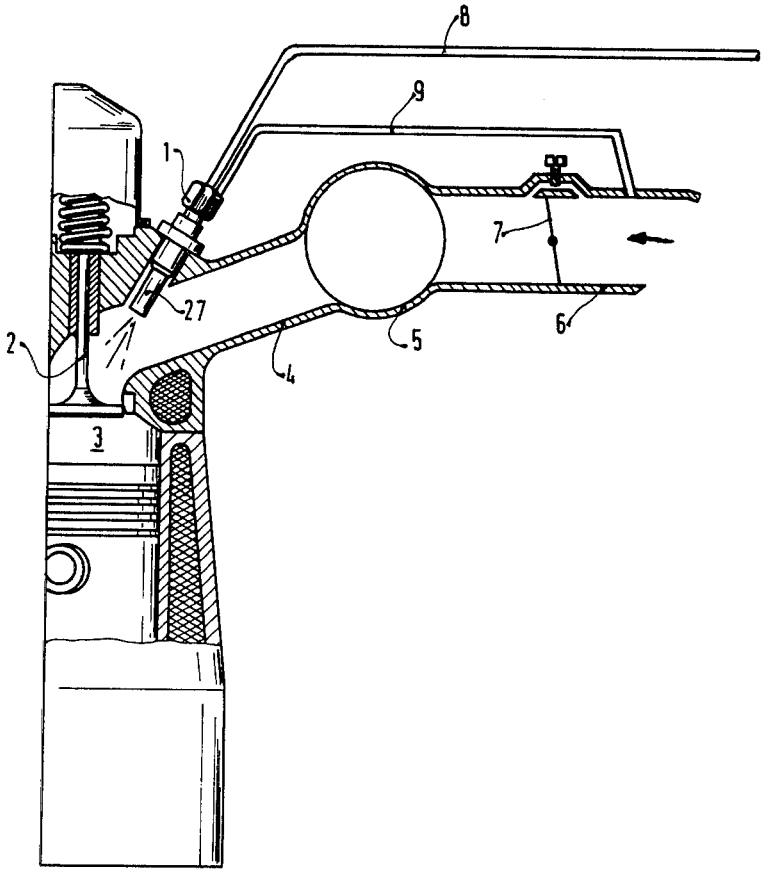
FIG. 1 is an overall view of the fuel system of the invention.

Referring now to FIG. 1 a fuel injection valve 1 is depicted, which serves as the low-pressure fuel injector and is disposed directly upstream of an engine intake valve 2 of a cylinder 3 of a mixture-compressing, externally ignited internal combustion engine having a single intake manifold section 4, into which this injector injects. The single intake manifold section 4 is connected to a main intake manifold 5. Upstream of the intake manifold section 6 is an arbitrarily actuable throttle valve 7. The fuel injection valve is part of an unillustrated fuel injection system which has a fuel apportionment apparatus through which, depending on the engine characteristics, a certain quantity of fuel is apportioned to the fuel injection valve 1 via an injection line 8. The fuel injection valve 1 is furthermore connected to an air line 9, which is connected to the intake manifold section 6 upstream of the throttle valve 7.

Figure 2:
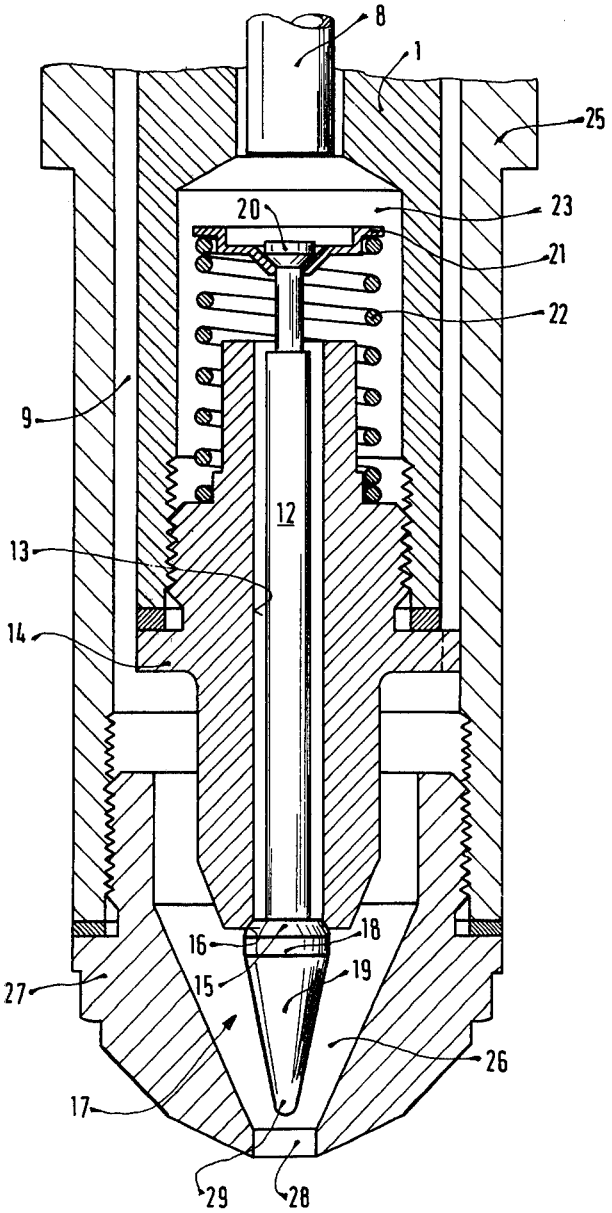
FIG. 2 is a sectional view of one embodiment of the fuel injection valve of the invention.

The fuel injection valve 1 shown in FIG. 2 has a valve needle 12 which is displaceably supported in a bore 13 of valve body 14. The valve needle 12 has a valve part 15 which cooperates with a fixed valve seat 16 provided on the valve body 14. Downstream of the valve part 15 the valve needle 12 is equipped with a fuel guidance cone 17, which is provided with a cylindrical section 18, adjacent to the valve part 15, and by a conical section of a cone 19. Because of the cylindrical section 18, the largest diameter of the valve part 15 and the conical cone section 19 is more easily formed during production. Furthermore, the diversion of the fuel which flows from valve part 15 to the conical cone section 19 is accomplished over a relatively small angle as a result of the cylindrical cone section 18, so as to prevent the fuel jet from lifting off at the point of transition from valve part 15 to fuel guidance cone 17. At its opposite end, the valve needle 12 is equipped with a head 20, which serves as support for a spring plate 21. A closing spring 22 is arranged to act upon spring plate 21, in the manner shown, with the opposite portion of the spring supported on the valve body 14.

The fuel supplied to the injection valve 1 via the injection line 8 from the fuel apportionment apparatus reaches a pressure chamber 23 of the valve housing 25, in which the closing spring 22 is disposed, and from there proceeds through the bore 13 to the valve seat 16. The fuel guidance cone 17 of the valve needle 12 projects into an air chamber 26, which is connected to the air line 9. The air chamber 26 is narrowed down to an ejection nozzle 28 in alignment with the valve needle 12. Given sufficient fuel pressure upstream of the valve part 15, the valve part 15 is pressed away from the valve seat 16, and the fuel comes out over the valve seat 16, flows along the contour of the fuel guidance cone 17 and the cone tip 29. From the tip 29 of the cone the fuel lifts off in a focused jet, and surrounded by an air envelope enters the intake manifold section 4 through the ejection nozzle 28. The presence of the fuel guidance cone 17 on the valve needle 12 downstream of the valve seat 16 enables the formation of a focused fuel jet even during full-load conditions for fuel quantities up to approximately 40 $cm^3$/min, during full-load, even though there is no prevailing air flow through the air line 9 because of the lack of a difference in pressure sections across the throttle valve 7, and there is hence no envelope of air around the fuel jet.

Figure 3:
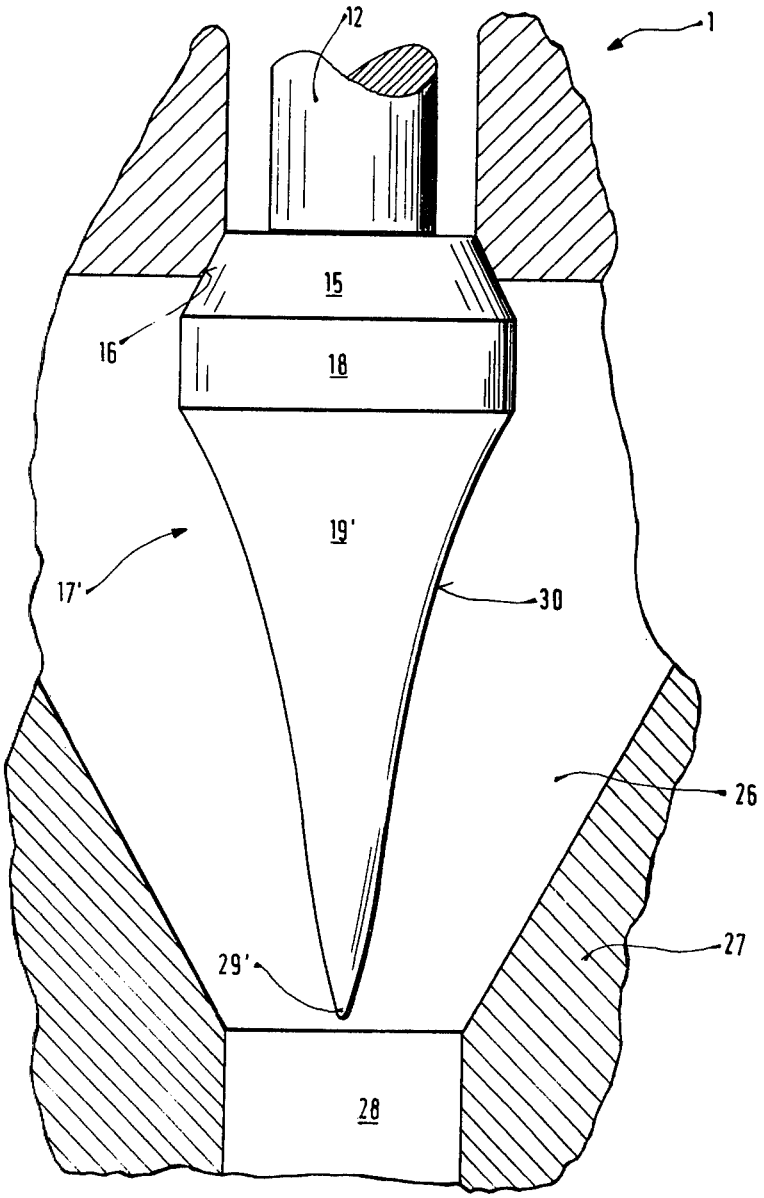
FIG. 3 is a sectional view of another embodiment of the injection valve fuel guidance cone.

In FIG. 3, an additional embodiment of a fuel injection valve is partially illustrated. Here the fuel guidance cone 17' is different from the fuel guidance cone 17 of FIG. 2 in that the surface 30 of fuel guidance cone 17' is concave and tapered to cone tip 29' tangentially. As a result of this, the cross flow component of the fuel jet is greatly reduced so that at minimum fuel flow of ca. 15 $cm^3$/min, and without an air envelope, a focused fuel jet can be sprayed through the injection nozzle 28 without wetting the nozzle wall. This is particularly necessary in the transition from idle to full-load, since here there is a rapid pressure increase in the intake manifold, and there is thus, no air flow prevailing in the air line 9, but the increase in fuel quantity occurs in delayed fashion.

Figure 4:
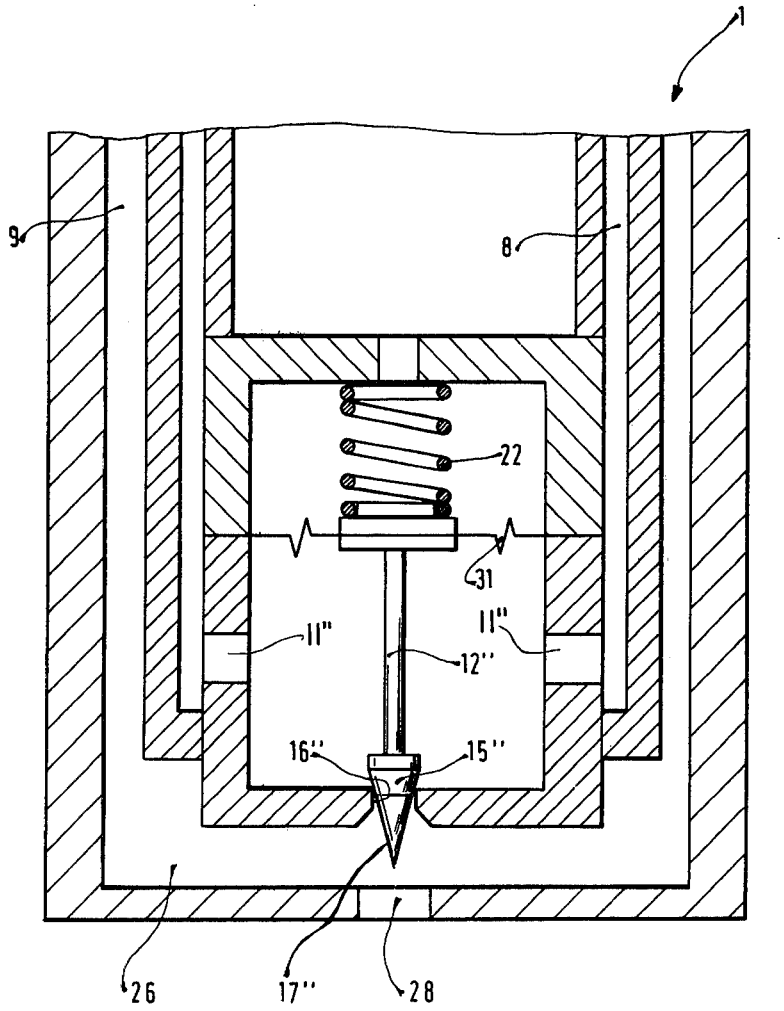
FIG. 4 is a sectional view of the invention wherein the valve opens in a direction opposite the direction of fuel flow.

In the fuel injection valve 1 illustrated in FIG. 4, a valve needle 12" is provided which has a valve part 15" which cooperates with the valve seat 16" and which is opened in a direction opposite to the fuel flow direction diaphragm 31, for example, on the end remote from the valve seat 16". The diaphragm 31 is actuated by pressure applied by the fuel supplied through openings 11" from line 8. The valve needle 12" is urged in the closing direction by closing spring 22". Downstream of valve part 15" the valve needle 12" is equipped with a tapering fuel guidance cone 17", which projects in the air chamber 26 connected with air line 9. This injection valve assures the production of a focused fuel jet without wetting the injection nozzle walls, even when no air envelope is provided during full-load conditions and during the transition from idle to full load.

What is claimed and desired to be secured by the Letters Patent of the United States is:

1. A fuel injection valve comprising:

a valve housing, said housing having therein;

an air conduit connected to an air chamber;

a fuel conduit connected to a fuel chamber;

a fuel injection nozzle opening;

a bore in said valve housing extending between said air chamber and said fuel chamber connecting said fuel chamber with said air chamber; a valve seat on the end of said bore extending into said air chamber;

a valve needle extending through said bore in said valve housing, said valve needle comprising a conical section valve seat engaging portion and a smooth tapered end portion tapering toward said fuel injection nozzle opening, said conical section valve seat engaging portion being positioned to engage the valve seat of said valve housing to close said bore against fuel flow, said tapered end portion being positioned centrally over said fuel injection nozzle opening in said housing and extending into said air chamber; and resilient means connected between said valve needle and said valve housing, said resilient means urging said valve needle in a direction toward said valve seat; whereby actuation of said valve needle in a direction relative to said valve seat controls fuel flow therethrough and along said tapered end portion of said valve needle into said air chamber.

2. The fuel injection nozzle according to claim 1 wherein the tapered end portion of said valve needle is conical in shape.

3. The fuel injection nozzle according to claim 2 wherein the tapered end portion of said valve needle is concave and tapers toward the tapered end tip tangentially.

4. The fuel injection nozzle according to claim 3, wherein said valve needle further comprises a cylindrical portion between said tapered end portion and said conical section valve seat engaging portion which blends into said conical shape.

5. The fuel injection nozzle according to claim 1 and further comprising;

a diaphragm means separating said fuel chamber from said air chamber, said resilient means being positioned upstream of said diaphragm means and urging said valve needle in the direction of fuel flow whereby increased fuel pressure causes said valve needle to move in a direction opposite to the direction of fuel flow and away from said valve seat.

6. The fuel injection nozzle according to claim 1, in which:

said valve needle includes a spring plate; and said resilient means is positioned between said valve housing and said spring plate coaxial with said valve needle;

said resilient means urging said valve needle in a direction opposite to that of fuel flow in said bore;

whereby actuation of said valve needle due to fuel pressure in a direction of fuel flow relative to said valve seat controls fuel flow therethrough and along said tapered end portion of said valve needle into said air chamber.

* * * * *